United States Patent [19]

Linnewiel

[11] Patent Number: 4,902,141

[45] Date of Patent: Feb. 20, 1990

[54] RESEALABLE FLEXIBLE PACKAGING AND SEALING TAPE THEREFOR

[76] Inventor: Ron Linnewiel, P.O. Box 63, Ramat Gam, Israel

[21] Appl. No.: 138,188

[22] Filed: Dec. 28, 1987

[30] Foreign Application Priority Data

Dec. 30, 1986 [IL] Israel ..... 81120

[51] Int. Cl.[4] ..... B65D 33/16; B65D 33/18; B65D 33/30; B65D 5/42

[52] U.S. Cl. ..... 383/61; 383/89; 428/40; 428/343; 428/352; 428/354

[58] Field of Search ..... 383/71, 78, 81, 82, 383/83, 89, 61; 229/48, 58; 428/40

[56] References Cited

U.S. PATENT DOCUMENTS

| | | | |
|---|---|---|---|
| 2,896,839 | 7/1959 | Barnes et al. | 229/DIG. 3 X |
| 3,412,926 | 11/1968 | Bostwick | 383/71 X |
| 4,008,851 | 2/1977 | Hirsch | 383/71 X |
| 4,168,196 | 6/1981 | Nemeth et al. | 604/390 |
| 4,402,453 | 9/1983 | Ragenstein, Jr. | 229/485 B X |
| 4,411,644 | 10/1983 | Tinklenberg | 428/43 X |

*Primary Examiner*—George F. Lesmes
*Assistant Examiner*—D. R. Zirker
*Attorney, Agent, or Firm*—Browdy & Neimark

[57] ABSTRACT

A plastic sealing tape for resealable flexible packaging comprising a tape having a first section provided with a permanent high-tack adhesive, and a second section being provided with a low-tack adhesive and being folded onto itself with the interposition of a layer of silicone, the second section having a free end being adhesive free.

4 Claims, 3 Drawing Sheets

FIG.1
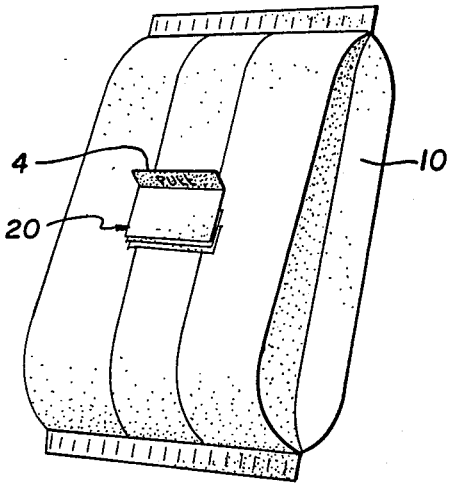
FIG.2
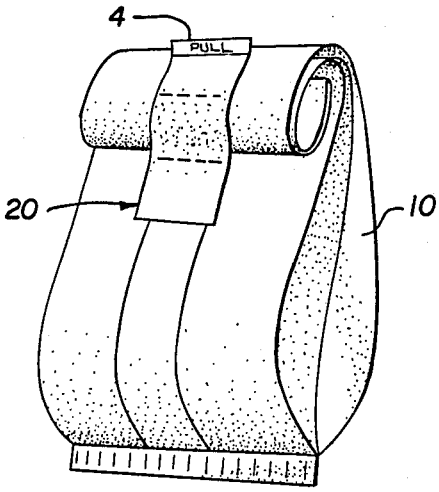
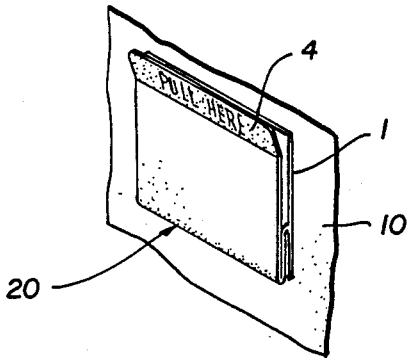
FIG.3
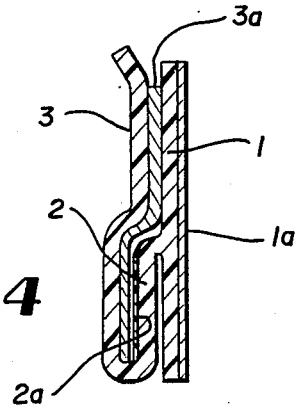
FIG.4
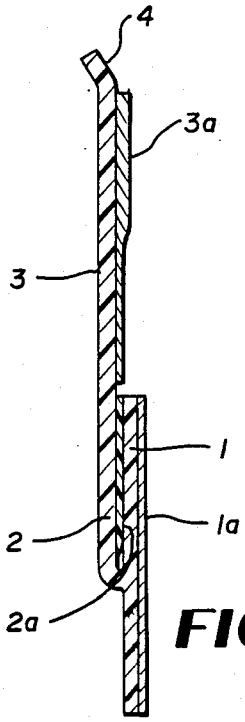
FIG.5

RESEALABLE FLEXIBLE PACKAGING AND SEALING TAPE THEREFOR

BACKGROUND OF THE INVENTION

The present invention concerns flexible packaging, made from one layer film or from laminate, in particular the kind of packaging used for marketing food stuffs in bulky or granular form, and a sealing tape therefore.

Most flexible packaging is usually made up of a laminated plastic film constituted by two or more laminations, the plastics for the outside laminate being chosen with a view to preserve the contents of the bag, and to carry the printed text. The inside film is chosen so as to provide good sealibility. The film for the bag is chosen to be more or less flexible depending on the product to be packaged. The bag is sealed at least along one longitudinal seam and at two-cross seams. In order to open the sealed package, one of the seams generally is torn or cut.

If the products packaged in these bags are bulky, e.g. cheese, olives or the like, the bags will bulge considerably. If the products are granular, i.e. ground coffee or nuts and the like, they will be distributed in the bag which will then be more or less flat. In either case, the package must be reclosable, since all the contents are generally not removed at one time, i.e. when the bag is first opened. The reclosing of the bag and sealing it, in this condition to prevent damage to the contents, presents a great problem and many attempts have been made to find a suitable solution.

In one type of reclosable flexible packaging an adhesive tape is attached across the width of the entire bag, and when the latter has been partly emptied, the open end is folded over once or twice onto itself, the tape is removed and is reapplied partly across the end of the fold and partly across the bag.

The main drawback of this solution is the fact that the packaged bag is bulky and is thus distorted by its contents, and so the tape, which is less flexible than the film of the bag, loosens automatically via the ends thereof which lift away from the surface of the bag. This presents a problem in the handling of an unopened bag, since these ends will become attached to adjacent packaged bags. If the bag has been opened and resealed, the seal will become loose. In either case, the tape may become detached altogether. Another disadvantage of this solution is the fact that the tape will not seal properly when applied to a full bag and this will effect the shelf life of the product. Further, dust can adhere to the tape, preventing it from performing its function.

In another type of reclosable flexible packaging, an adhesive tape is provided across an opening in the bag. This opening may be an unsealed seam, a slit, or perforations which are to be torn to provide the opening. When the bag is to be opened, the tape is partially lifted and some of the contents are removed through this opening. Thereafter, the bag is held at the two ends of the opening and the ends are pulled away from each other to close the opening. The removed part of the tape is then pressed back to its former position.

The main drawback of this type of resealing is, as in the above mentioned type, the fact that the tape, when applied to a full bag, will not seal properly and therefore will adversely affect the shelf life of the product. Furthermore, if the contents of the bag are granular, they will adhere to the tape so that it can no longer perform its function.

A further consideration in making resealable flexible packaging is the attachment of the sealing means during or after the production of the bag itself which is accomplished with a minimum increase of costs.

SUMMARY OF THE INVENTION

It is the object of the present invention to provide resealable flexible packaging which overcomes the above mentioned disadvantages and problems in the manufacture, handling, as well as use of the bags known up to now.

The invention consists of resealable flexible packaging comprising the bag and a relatively short plastic tape, one section of which is provided with a permanent high tack adhesive on one surface and is attached to the bag at a suitable distance from the end which is to be opened. Another section is provided with a low tack adhesive folded onto itself with the interposition of a layer of silicone, the free end of the second section facing the end of the bag to be opened and being adhesive free to serve as a finger lift.

Still other objects, features and attendant advantages of the present of invention will become apparent to skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which:

FIG. 1 shows the bag when the bag is full and yet closed and the tape is attached to the bag according to the present invention;

FIG. 2 shows the bag when it is partially empty, and therefore open, and the tape is used to close the bag according to the present invention;

FIG. 3 is a plan view of the tape according to the present invention;

FIG. 4 is a cross-sectional view of the tape in its formation when the bag has not yet been opened;

FIG. 5 is a cross-sectional view of the tape in use after the bag has been opened.

DETAILED DESCRIPTION OF THE PREFERRED EMBODIMENTS

FIGS. 1 and 2 illustrate, generally, the way in which the tape according to the present invention is attached to the bag. FIG. 1 shows the bag 10 when it is full and closed, and the tape 20 is attached to seal the bag. FIG. 2 illustrates the case in which the bag 10 has been opened, partially emptied, and a tape 20 is used to reclose the bag so as to provide a tight seal.

FIGS. 3–5 illustrate close views of the tape 20 itself. In these figures, like elements have been given like reference numerals.

The plastic sealing tape according to the invention comprises a flat section 1 which is provided with a permanent high-tack adhesive 1*a* which it is attached to the bag 10 at a suitable distance from that end of the bag which is to be opened. The flat section 1 is integral approximately in its median area with a tape section 2 which extends downwardly, i.e. away from the end of the bag to be opened, and is provided with a silicone layer 2a on the side away from section 1. Tape section merges at its bottom into a tape section 3 which is folded onto section 2 and extends above it, being provided with a layer 3a of low-tack adhesive. The upper end 4 of section 3, which is free of any adhesive, constitutes a finger pull.

The terms high-tack and low-tack adhesives are well known in the industry and do not require detailed explanation, the high-tack adhesive adhering permanently to a surface, while the low-tack adhesive adheres well, but can be removed and reattached a great number of times.

In a preferred embodiment of the invention, the suitable distance separating the tape portion 1 and the end of the bag is equal to at least the space required for folding over the end of the bag two times.

The tape 20 is made of a thin film of plastics material, e.g. polypropylene, polyvinyl chloride or the like. It is preferably of a width of between 10%–30% of the width of the package, the actual width depending on the flexibility of the bag after it has been filled, i.e. granular contents require a narrower tape to hold the folded-over end of the bag, while bulky contents require a wider tape.

In use, the bag 10 is opened and as much of the contents as necessary is removed. Thereafter, the open end of the bag, which now lies flat, is folded over at least twice, a process which seals the bag substantially hermetically. The tape 20 is then grasped by the fingerlift 4 and is pulled, which causes the low-tack adhesive section 3 to unfold and to become one straight piece, so that it can be applied to the folded-over part of the bag 10 to which it will adhere tightly.

It can be appreciated that the silicone layer 2a provides a divider between tape section 2 and the lower part of tape section 3 to prevent the latter from sticking to tape section 2, thus facilitating the easy separation of said tape sections 2 and 3 when the tape is to be used for sealing. The upper part of section 3 is easily removed from the back of section 1 by finger pull 4, while silicone layer 2a permits the easy unfolding of the bottom part of section 3 whereby the entire section 3 is available to provide a good seal for the bag 10.

When the bag 10 is to be reopened, the finger lift 4 is grasped and the low-tack section 3 of the tape 20 is peeled off from the folded part of the bag 10 and is again folded onto itself. Thus, while the contents of the bag 10 are removed, the tape 20 will not become dirty and thus loose its ability to stick. The resealing process can be repeated as many times as required, without impairing the tape 20, the bag 10 or its contents.

The tape can easily be attached, by conventional means well known in the industry, to a prefabricated bag or in coordination with the actual manufacturing and/or filling machinery of the bag itself. Although the tape will, according to the invention, project beyond the surface of the bag, it will not interfere with the handling of either an empty or a full bag, since it is very thin and flexible, and applies itself against the flat or the bulging surface of a filled bag, since, when not in use, the tape is folded onto itself, it will not adhere to any other surface such as an adjacent bag. At no time, either during filling or emptying the bag, will the tape be in contact with the packaged product.

The foregoing description of the specific embodiments will successfully reveal the general nature of the invention that others can by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A plastic sealing tape for resealable flexible packaging comprising a tape having a first section provided with a permanent high-tack adhesive, and a second section being provided with a low-tack adhesive and being folded onto itself with the interposition of a layer of silicone, said second section having a free end being adhesive free.

2. Resealable flexible packaging comprising a bag and the plastic tape according to claim 1, wherein said first section with high-tack adhesive is attached to the bag at a suitable distance from an end of the bag to be opened, and said packaging comprises a finger lift formed by said free end of said second section faces said end of the bag to be opened.

3. Resealable flexible packaging according to claim 2, wherein said suitable distance is equal to at least the space required for folding over the end of the bag to be opened twice.

4. Resealable flexible packaging according to claim 2, wherein the width of said plastic the tape is preferably 10%–30% of the width of the bag.

* * * * *